US009094768B2

(12) United States Patent
LaBosco

(10) Patent No.: US 9,094,768 B2
(45) Date of Patent: Jul. 28, 2015

(54) LOUDSPEAKER CALIBRATION USING MULTIPLE WIRELESS MICROPHONES

(75) Inventor: Mark LaBosco, New City, NY (US)

(73) Assignee: Crestron Electronics Inc., Rockleigh, NJ (US)

( * ) Notice: Subject to any disclaimer, the term of this patent is extended or adjusted under 35 U.S.C. 154(b) by 544 days.

(21) Appl. No.: 13/564,805

(22) Filed: Aug. 2, 2012

(65) Prior Publication Data

US 2014/0037097 A1 Feb. 6, 2014

(51) Int. Cl.
*H04R 29/00* (2006.01)
*H04S 7/00* (2006.01)

(52) U.S. Cl.
CPC ..... *H04R 29/001* (2013.01); *H04S 7/302* (2013.01); *H04R 2420/07* (2013.01)

(58) Field of Classification Search
CPC ... H04R 29/001; H04R 2420/07; H04S 7/302
USPC ..... 381/59
See application file for complete search history.

(56) References Cited

U.S. PATENT DOCUMENTS

| | | | |
|---|---|---|---|
| 4,458,362 | A | 7/1984 | Berkovitz et al. |
| 4,739,513 | A | 4/1988 | Kunugi et al. |
| 4,888,809 | A | 12/1989 | Knibbeler |
| 5,109,419 | A | 4/1992 | Griesinger |
| 5,386,478 | A | 1/1995 | Plunkett et al. |
| 5,511,129 | A | 4/1996 | Craven et al. |
| 5,572,443 | A | 11/1996 | Emoto et al. |
| 5,627,899 | A | 5/1997 | Craven et al. |
| 5,815,580 | A | 9/1998 | Craven et al. |
| 6,760,451 | B1 | 7/2004 | Craven et al. |
| 6,954,538 | B2 | 10/2005 | Shiraishi et al. |
| 7,158,643 | B2 | 1/2007 | Lavoie et al. |
| 7,225,135 | B2 | 5/2007 | Thomas |
| 7,483,540 | B2 | 1/2009 | Rabinowitz et al. |
| 7,526,093 | B2 | 4/2009 | Devantier et al. |
| 7,567,675 | B2 | 7/2009 | Bharitkar et al. |
| 7,769,183 | B2 | 8/2010 | Bharitkar et al. |
| 8,005,228 | B2 | 8/2011 | Bharitkar et al. |

(Continued)

FOREIGN PATENT DOCUMENTS

JP 2000-261900 A 9/2000

OTHER PUBLICATIONS

Audyssey Laboratories, "How to MultEQ", 1 page, undated, http://www.audyssey.com/sites/default/files/attachments/onesheet_howtomulteq.pdf.

(Continued)

*Primary Examiner* — Paul S Kim
(74) *Attorney, Agent, or Firm* — Crestron Electronics Inc.

(57) ABSTRACT

An illustrative embodiment includes a method for use in performing acoustic calibration of at least one audio output device for a plurality of listening locations. An audio input device generates a data signal based on a series of one or more tones output by the at least one audio output device. The audio input device wirelessly transmits the data signal to a calibration device. The audio input device is one of a plurality of audio input devices deployed at respective ones of the plurality of listening locations. The data signal is one of a plurality of data signals generated by respective ones of the plurality of audio input devices based on the series of one or more tones output by the at least one audio output device. The plurality of data signals are wirelessly transmitted by the respective ones of the plurality of audio input devices to the calibration device.

36 Claims, 4 Drawing Sheets

(56) References Cited

U.S. PATENT DOCUMENTS

| | | | | |
|---|---|---|---|---|
| 8,094,826 | B2 | 1/2012 | Pedersen | |
| 8,150,047 | B2 | 4/2012 | Rabinowitz et al. | |
| 2005/0008170 | A1 | 1/2005 | Pfaffinger et al. | |
| 2005/0031135 | A1 | 2/2005 | Devantier et al. | |
| 2006/0147057 | A1 | 7/2006 | Aggarwal et al. | |
| 2010/0142735 | A1* | 6/2010 | Yoon et al. | 381/303 |
| 2010/0272270 | A1 | 10/2010 | Chaikin et al. | |

OTHER PUBLICATIONS

Bose Corporation, "Using the ADAPTiQ® audio calibration system", 2 pages, undated, http://worldwide.bose.com/productsupport/en/web/article_102_running_adaptiq/page.html.

Pat Brown et al., "Wireless Room Measurements", 2004, 2 pages, SynAudCon Newsletter, vol. 32, No. 4, http://www.lectrosonics.com/images/PDFs/synaudcontm400article.pdf.

Cambridge Silicon Radio PLC, "BlueCore5™ Multimedia", undated, 2 pages, http://www.csr.com/products/download/16.

Harman International Industries, Inc., "Harman Kardon's EzSet™ Remote: Takes the guesswork out of speaker level matching", Mar. 2001, 1 page, http://www.myharman.net/HK/Technology%20Articles/HKH1105-EzSet%20Storyboard.pdf.

Harman International Industries, Inc., "MC-12 Controller Version 4 EQ User Guide", Jun. 2004, 42 pages, http://www.lexicon.com/downloads/products/prod_15_634472770282055361_MC-12HD_EQ_R0.pdf.

Harman International Industries, Inc., "Comparing the MC-12HD and RV-5/MV-5 EQ Calibrations", 2008, 4 pages, http://www.lexicon.com/downloads/products/prod_15_634472768562240305_Lexicon_EQ_MC-12EQ_vs_RV-5.pdf.

Lectrosonics, "TM400 Wireless Test and Measurement System Quick Start Guide", Mar. 19, 2007, 4 pages, http://www.lectrosonics.com/images/QuickStartGuides/qsg_tm400.pdf.

Lectrosonics, "TM400 Test and Measurement Wireless System Technical Data", Aug. 9, 2010, 2 pages, http://www.lectrosonics.com/images/TD-sheets/tm400td.pdf.

Lyngdorf, "RoomPerfect™ Product Description", undated, 6 pages, http://www.lyngdorf.com/downloads/product_descriptions/roomperfect_productdescription_english.pdf.

Lyngdorf, "Owner's manual: RP-1 RoomPerfect™", Aug. 9, 2011, 40 pages, http://www.lyngdorf.com/images/stories/Download/Manuals/RP-1%20Owners%20Manual.pdf.

Panasonic Corporation, "Omnidirectional Back Electret Condenser Microphone Cartridge WM-61A", undated, 1 page, http://industrial.panasonic.com/www-data/pdf/ABA5000/ABA5000CE22.pdf.

Summit Semiconductor, LLC, "MyZone™ Technology: Home Theater Surround Calibration with a Press of a Button", Feb. 10, 2011, 12 pages, http://summitwireless.com/FS848_Whitepaper_MyZone_v1_2.pdf.

Telex Communications, Inc., "RTM-1 Remote Test Wireless System", Nov. 2001, 2 pages, http://pdf.textfiles.com/manuals/STARINMANUALS/Bosch%20-%20EV/RTM-1.pdf.

Telex Communications, Inc., "RTM-1000 Remote Test Wireless System", undated, 1 page, http://www.electrovoice.com/downloadfile.php?i=1394.

* cited by examiner

LOUDSPEAKER CALIBRATION USING MULTIPLE WIRELESS MICROPHONES

BACKGROUND OF THE INVENTION

1. Technical Field

This invention relates generally to techniques for acoustic calibration of one or more audio output devices (e.g., loudspeakers), and more particularly to techniques which utilize multiple wireless audio input devices (e.g., wireless microphones) for performing such calibration.

2. Background Art

Home theaters typically include a receiver (and/or preamplifier and/or amplifier) coupled to a plurality of speakers which collectively function to provide an immersive audio experience within a listening area. However, home theater setup requires proper calibration of speaker levels, speaker distances and equalization to get the full immersive experience intended by content creators. Calibration typically includes setting speaker and subwoofer volume levels and the speaker-subwoofer crossover point, as well as employing equalization to balance the frequency response of all the speakers and try to minimize room acoustic problems.

Many commercially-available home theater output devices include an automatic speaker calibration system which sends test tones through all of the speakers and the subwoofer and uses a single wired microphone to capture the sounds of the speakers at one or more locations.

Many conventional arrangements involve taking measurements at a single location within the listening area (e.g., one seat in a room), and thus only attempt to optimize the listening experience for that single location. For example, the EzSet® system was developed by Harman International Inc. utilizing technology described in U.S. Pat. No. 5,386,478, the disclosure of which is incorporated herein. Literature available on Harman International Inc.'s website on the filing date of the present application is submitted herewith and incorporated by reference herein. Other techniques involve the use of multiple microphones at a single listening location, such as the techniques disclosed by U.S. Pat. No. 6,954,538 and U.S. Pat. No. 7,095,455, the disclosures of which are incorporated herein.

However, the aforementioned techniques each only attempt to optimize the listening experience for a single listening location within a listening area. Each of the aforementioned techniques therefore suffer from a significant disadvantage in that optimizing the listening experience for a single location typically results in a diminished listening experience at other locations within the listening area (e.g., other seats in the room) because a measurement at a single location cannot provide an accurate representation of the acoustical problems present within the entire listening area. Other techniques have been developed which attempt to address this problem by utilizing measurements obtained at multiple locations to attempt to optimize performance for multiple listeners within a large listening area.

The ADAPTiQ® audio calibration process was developed by Bose® utilizing technology described in U.S. Pat. No. 7,483,540, the disclosure of which is incorporated by reference herein. Literature available on Bose's website on the filing date of the present application is submitted herewith and incorporated by reference herein. The MultEQ® acoustical correction technology was developed by Audyssey Laboratories utilizing technology described in U.S. Pat. No. 7,567,675, the disclosure of which is incorporated by reference herein. Literature available on Audyssey Laboratories' website on the filing date of the present application is submitted herewith and incorporated by reference herein. The RoomPerfect® audio calibration process was developed by Lyngdorf utilizing technology described in U.S. Pat. No. 8,094,826, the disclosure of which is incorporated by reference herein. Literature available on Lyngdorf's website on the filing date of the present application is submitted herewith and incorporated by reference herein.

The ADAPTiQ®, MultEQ®, and RoomPerfect® processes each involve the use of a single wired microphone to make a series of measurements sequentially as the single wired microphone is moved to multiple locations within the listening area. Measurements typically need to be taken at between 3 and 32 locations, which can be a very time-consuming and tedious process.

Room EQ calibration was developed by Harman International Inc. utilizing technology described in U.S. Patent Application Publication No. 2006/0147057, the disclosure of which is incorporated by reference herein, and is commercially available in Harman International Inc.'s Lexicon® MC-12 and MC-12 Controllers. Literature available on Harman International Inc.'s website on the filing date of the present application is submitted herewith and incorporated by reference herein.

Room EQ calibration uses four wired microphones to simultaneously measure acoustical characteristics at multiple locations within a listening room. The multiple wired microphones are all connected to a single signal block which stores raw samples from the multiple microphones and the single signal block calculates the frequency response of each microphone.

Although Room EQ calibration offers certain advantages relative to the ADAPTiQ®, MultEQ®, and RoomPerfect® processes by allowing for simultaneous, rather than sequential, measurement of acoustical characteristics at multiple locations within a listening room, each of these processes requires the use of a specific wired microphone. Each of these processes explicitly warns that use of any other type of microphone (e.g., a wireless microphone) would result in inaccurate results. Moreover, modifying these arrangements to utilize one or more wireless microphones would require substantial redesign of the receivers.

However, the use of a wired microphone has disadvantages: moving between locations with a wired microphone can be cumbersome, especially where these locations are distant from the receiver or from each other. For example, distributed audio systems are installations where there are many rooms with speakers that have speaker cables that run back to a central equipment location, such an equipment closet, where the receiver (and/or preamplifier and/or amplifier) may be located. Distributed audio systems are often difficult to calibrate due to the distance between the centralized equipment location and the room where the speakers are located. These difficulties are exacerbated by the use of a wired microphone for calibration, which may require the microphone cable to go up or down stairs and/or travel down hallways to reach the room in which the speakers to be calibrated are located.

Other conventional arrangements include Pioneer Corp.'s MCACC® (Multi-Channel Acoustic Calibration), Sony Corp.'s DCAC® (Digital Cinema Auto Calibration), Yamaha Corp.'s YPAO® (Yamaha Parametric Room Acoustic Optimizer), Samsung's ASC (Automatic Sound Calibration), JBL's RMC (Room Mode Correction), and TaCT Audio's RCS (Room Correction System) originally developed by Snell Acoustics. Each of these conventional arrangements requires the use of a single wired microphone to make measurements at one or more locations, and thus suffers from one or more of the deficiencies discussed above.

Telex Communications Inc. has sold systems referred as the Electro-Voice® RTM-1 Remote Test Wireless System and the Electro-Voice® RTM-1000 Remote Test Wireless System, and Lectrosonics® sells a system referred to as the TM400 Test and Measurement Wireless System. Literature describing these systems is submitted herewith and incorporated by reference herein.

As described in the accompanying literature, each of these systems includes a single wireless transmitter which is paired with a single wireless receiver in that the transmitter and the receiver utilize the same wireless channel. The signals transmitted wirelessly from a given transmitter to a given receiver over a given wireless channel are raw audio signals, with optional companding (compressing/expanding) for greater dynamic range. The single wireless receiver is only able to receive and process signals from the single wireless transmitter, which in turn is connected to a single (wired) microphone via a cable. Simultaneous utilization of multiple microphones with these systems would require the use of multiple receivers paired with multiple transmitters, with each receiver-transmitter pair operating over a different wireless channel, and would also require substantial modifications and/or redesigns of the receiver(s) so as to allow for processing of signals received from multiple microphones rather than from a single microphone.

Thus, there is a long-felt need for an acoustic calibration system which permits the use of multiple wireless microphones, preferably utilizing a single receiver and a single wireless channel, to perform simultaneous measurements at multiple listening locations within a listening area.

SUMMARY OF THE INVENTION

It is to be understood that both the general and detailed descriptions that follow are exemplary and explanatory only and are not restrictive of the invention.

A first embodiment includes a method for use in performing acoustic calibration of at least one audio output device for a plurality of listening locations. An audio input device generates a data signal based on a series of one or more tones output by the at least one audio output device. The audio input device wirelessly transmits the data signal to a calibration device. The audio input device is one of a plurality of audio input devices deployed at respective ones of the plurality of listening locations. The data signal is one of a plurality of data signals generated by respective ones of the plurality of audio input devices based on the series of one or more tones output by the at least one audio output device. The plurality of data signals are wirelessly transmitted by the respective ones of the plurality of audio input devices to the calibration device.

A second embodiment includes an audio input device for use in performing acoustic calibration of at least one audio output device for a plurality of listening locations. The audio input device includes a processor operative to generate a data signal based on a series of one or more tones output by the at least one audio output device. The audio input device also includes a communicator operative to wirelessly transmit the data signal to a calibration device. The audio input device is one of a plurality of audio input devices deployed at respective ones of the plurality of listening locations. The data signal is one of a plurality of data signals generated by respective ones of the plurality of audio input devices based on the series of one or more tones output by the at least one audio output device. The plurality of data signals are wirelessly transmitted by the respective ones of the plurality of audio input devices to the calibration device.

A third embodiment includes a method for use in performing acoustic calibration of at least one audio output device for a plurality of listening locations. The method includes a calibration device wirelessly receiving a plurality of data signals from respective ones of a plurality of audio input devices deployed at respective ones of the plurality of listening locations. The method also includes the calibration device performing the acoustic calibration of the at least one audio output device based on the plurality of data signals. Each of the plurality of data signals is generated by a respective one of the plurality of audio input devices based on a series of one or more tones output by the at least at least one audio output device.

A fourth embodiment includes a calibration device for use in performing acoustic calibration of at least one audio output device for a plurality of listening locations. The calibration device includes a communicator operative to wirelessly receive a plurality of data signals from respective ones of a plurality of audio input devices deployed at respective ones of the plurality of listening locations. The calibration device also includes a processor operative to perform the acoustic calibration of the at least one audio output device based on the plurality of data signals. Each of the plurality of data signals is generated by a respective one of the plurality of audio input devices based on a series of one or more tones output by the at least at least one audio output device.

A fifth embodiment includes a system for use in performing acoustic calibration of at least one audio output device for a plurality of listening locations. The system comprises a plurality of audio input devices deployed at respective ones of the plurality of listening locations and a calibration device. The plurality of audio input devices wirelessly transmits a plurality of data signals to the calibration device. Each of said plurality of data signals is generated by a respective one of said plurality of audio input devices based on a series of one or more tones output by said at least one audio output device.

A sixth embodiment includes a method for use in performing acoustic calibration of at least one audio output device for a plurality of listening locations. The method includes a plurality of audio input devices generating respective ones of a plurality of data signals based on a series of one or more audio tones output by the at least one audio output device. The method also includes the plurality of audio input devices wirelessly transmitting the plurality of data signals to a calibration device. The plurality of audio input devices are deployed at respective ones of said plurality of listening locations.

A seventh embodiment includes a method for use in performing acoustic calibration of at least one loudspeaker for a plurality of listening locations. The method includes a calibration device transmitting a first signal substantially simultaneously to a plurality of wireless microphones deployed at respective ones of the plurality of listening locations. The method also includes, responsive to a given one of the plurality of wireless microphones receiving the first signal, the given wireless microphone generating a second signal based on a series of one or more tones output by the at least one loudspeaker. The method further includes the calibration device transmitting a third signal sequentially to respective ones of the plurality of wireless microphones. The method additionally includes, responsive to the given wireless microphone receiving the third signal, the wireless microphone wirelessly transmitting the second signal to the calibration device. The second signal is one of a plurality of signals substantially simultaneously generated by respective ones of the plurality of wireless microphones based on the series of one or more tones output by the at least one loudspeaker. The plurality of signals is sequentially wirelessly transmitted by the respective ones of the plurality of wireless microphones to the calibration device responsive to the respective ones of the plurality of wireless microphones receiving the third signal. The calibration device performs the acoustic calibration of the at least one loudspeaker based on the plurality of signals.

DISCLOSURE OF INVENTION

Brief Description of Drawings

The accompanying figures further illustrate the present invention.

BRIEF DESCRIPTION OF THE SEVERAL VIEWS OF THE DRAWING

Figure 1:
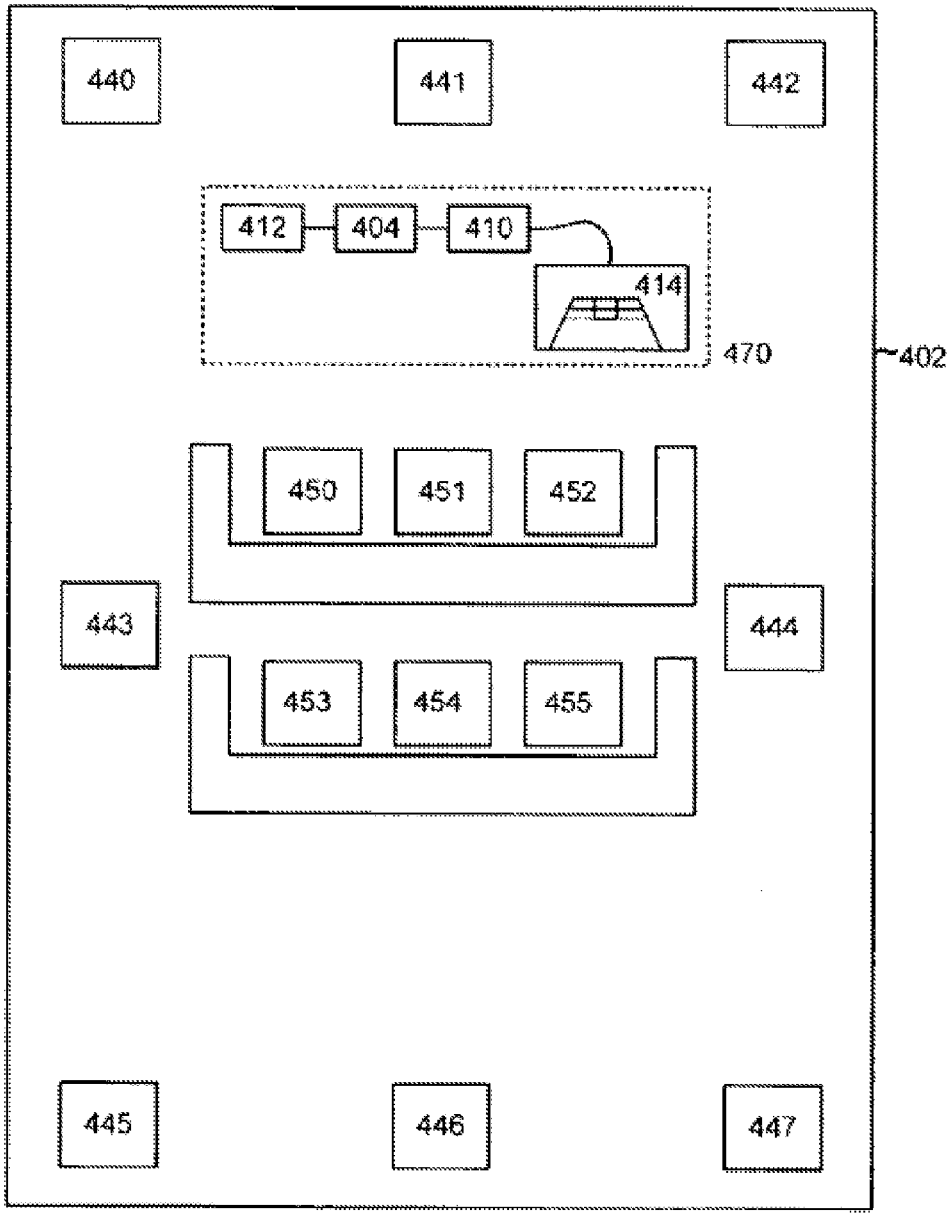

FIG. 1 shows an exemplary theater setup suitable for use with an embodiment of the present invention.

Figure 2:
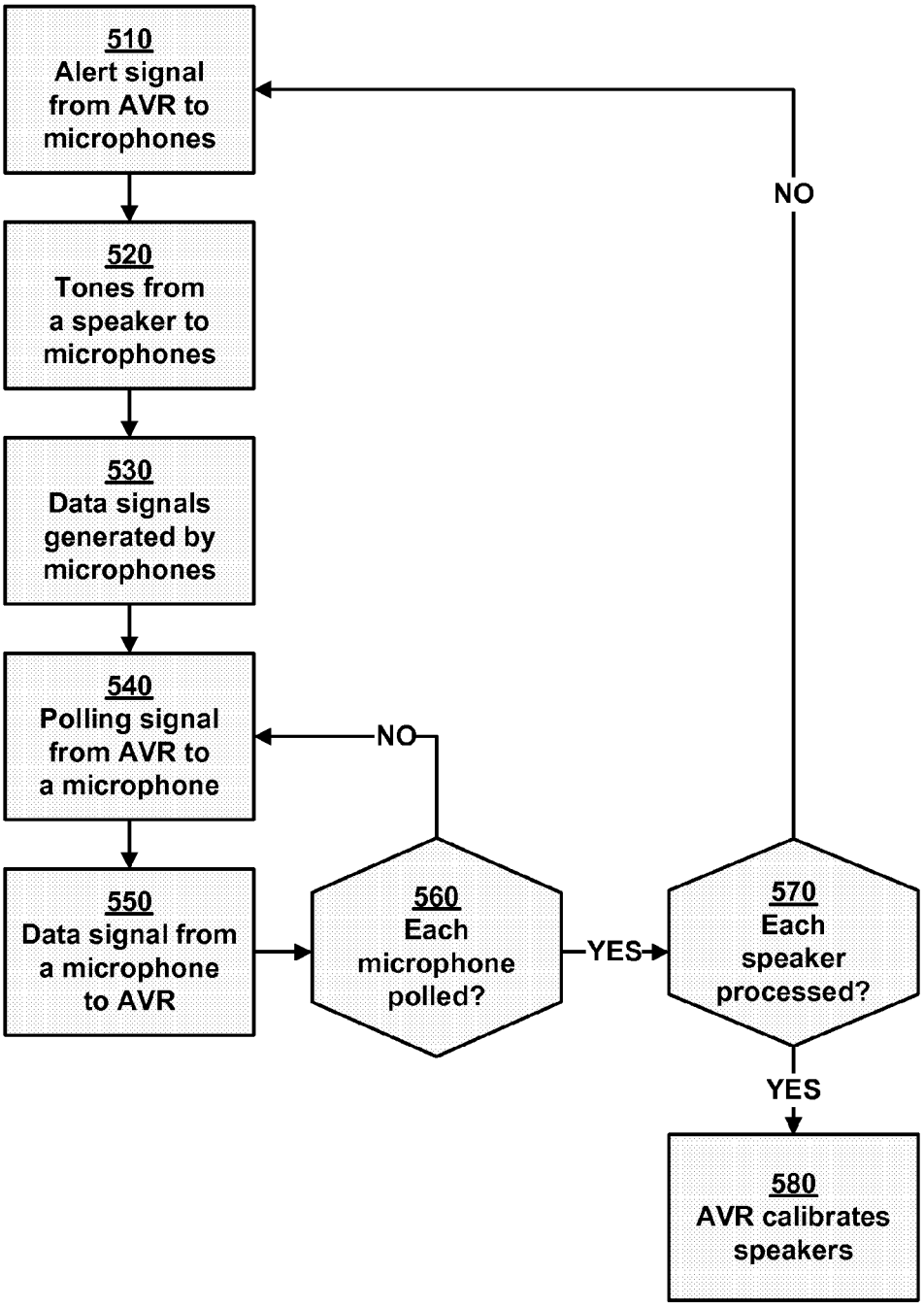

FIG. 2 shows an exemplary method suitable for use with an embodiment of the present invention.

Figure 3:
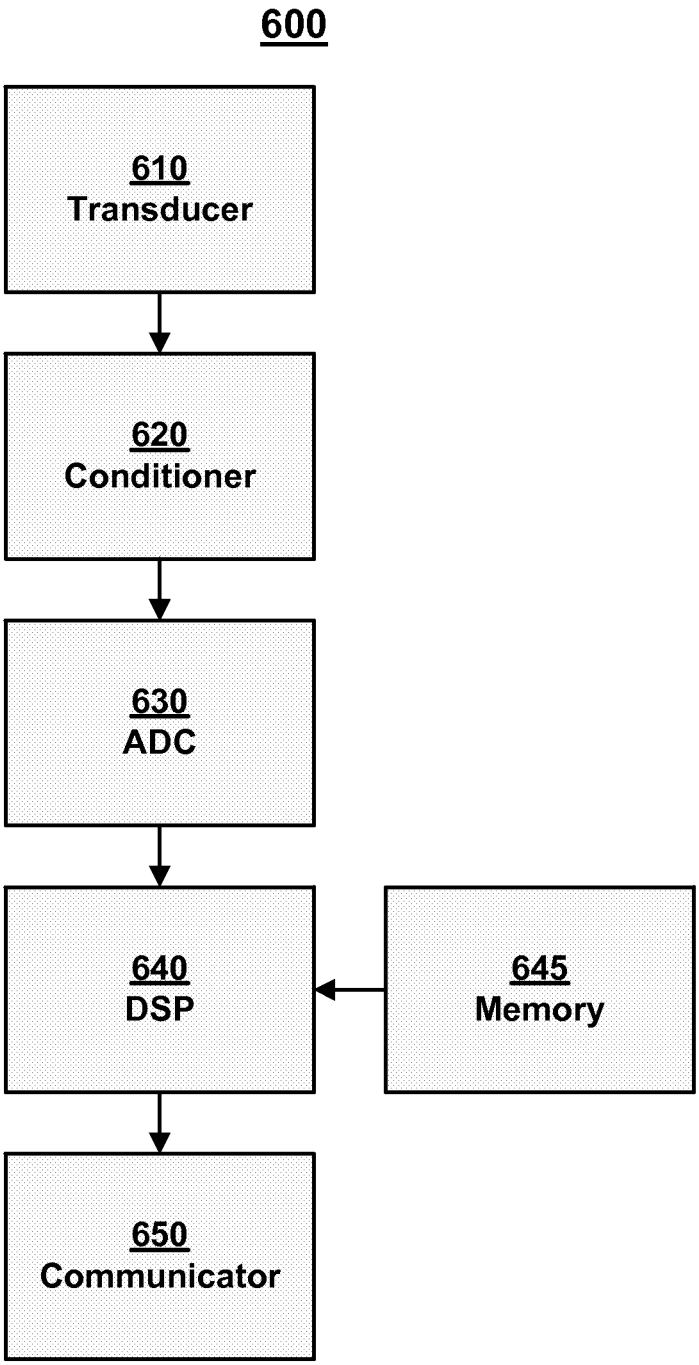

FIG. 3 shows a wireless audio input device suitable for use with an embodiment of the present invention.

Figure 4:
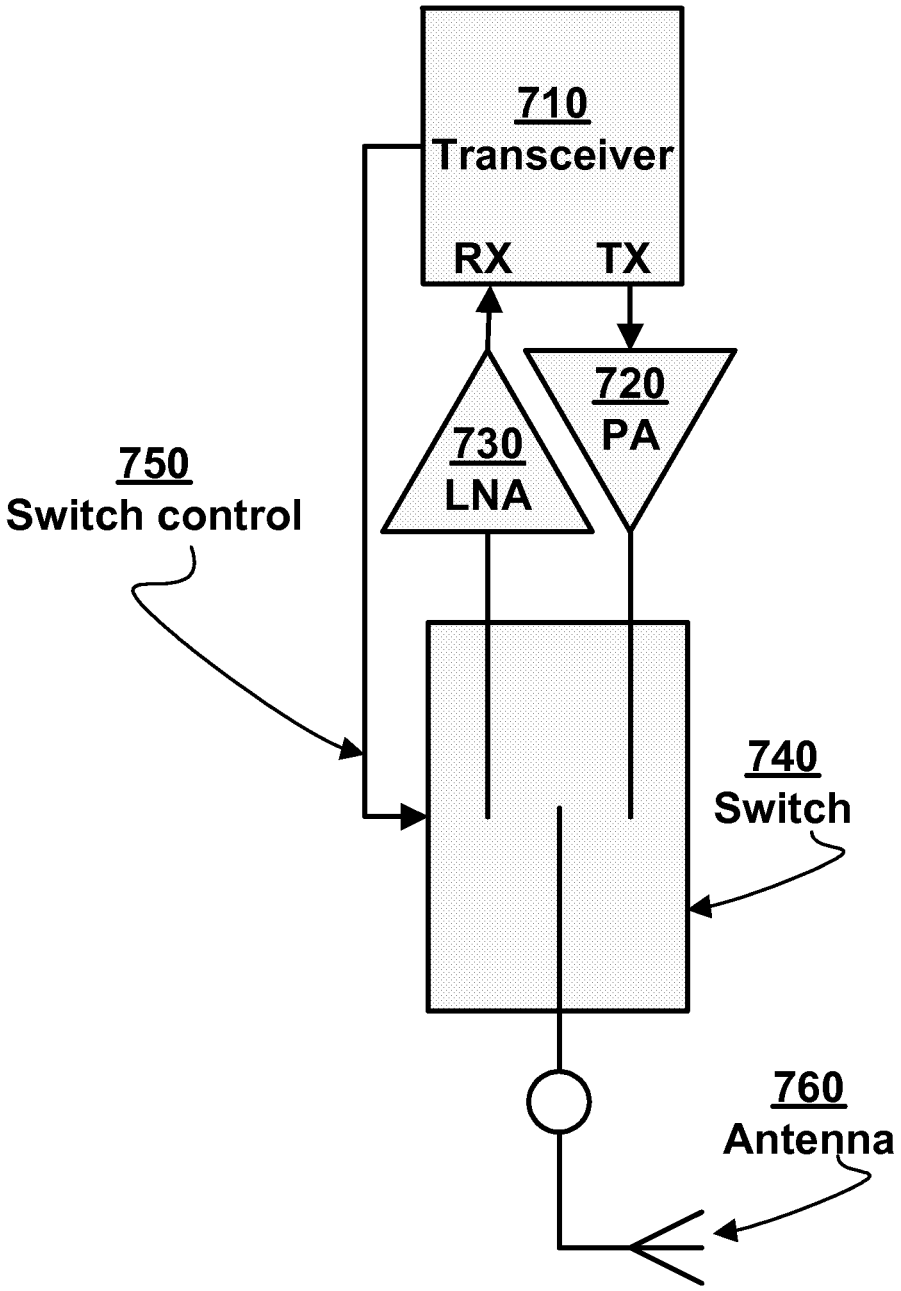

FIG. 4 shows an exemplary communicator suitable for use with an embodiment of the present invention.

LIST OF REFERENCE NUMBERS FOR THE MAJOR ELEMENTS IN THE DRAWINGS

The following is a list of the major elements in the drawings in numerical order.

402 listening area
404 audio processor
410 computing device
412 audio signal generator
414 communicator
440 front left speaker
441 front center (primary) speaker
442 front right speaker
443 surround (center) left speaker
444 surround (center) right speaker
445 rear left speaker
446 rear center speaker
447 rear right speaker
450 front left seating position
451 front center (primary) seating position
452 front right seating position
453 rear left seating position
454 rear center seating position
455 rear right seating position
470 audio-video receiver (AVR)
510 method step of sending alert signal from AVR to microphone
520 method step of sending tones from a speaker to microphones
530 method step of generating data signals by microphones
540 method step of sending polling signal from AVR to a microphone
550 method step of sending data signal from a microphone to AVR
560 method step of testing whether each microphone has been polled
570 method step of testing whether each speaker has been processed
580 method step of AVR performing acoustic calibration of speakers
600 wireless microphone
610 transducer
620 conditioner
630 analog-to-digital converter (ADC)
640 digital signal processor (DSP)
645 memory
650 communicator
710 transceiver
720 power amplifier (PA)
730 low-noise amplifier (LNA)
740 switch
750 switch control signal
760 antenna

DETAILED DESCRIPTION OF THE INVENTION

The present invention is a technique which advantageously utilizes multiple wireless audio input devices for performing calibration of one or more audio output devices.

Mode(s) for Carrying Out the Invention

FIG. 1 shows an exemplary theater setup suitable for use with an embodiment of the present invention. The theater setup is configured within listening area 402, which may be a living room or conference room. The theater setup includes a calibration device (e.g., audio-video receiver (AVR) 470), audio output devices (e.g., loudspeakers 440-447), and six listening positions 450-455. As would be understood by one skilled in the art, the number, location and configuration of loudspeakers and listening positions shown in FIG. 1 are purely exemplary and may be varied.

Moreover, some or all of the functionality described herein as being associated with AVR 470 could be implemented using another component or a combination of components in addition to or instead of AVR 470, including but not limited to one or more personal computers (PCs), amplifiers, preamplifiers, decoders, and/or sound processors. In this embodiment, AVR 470 includes a communicator 414, a computing device 410, an audio processor 404, and an audio signal generator 412 (which may include an audio power amplifier). Communicator 414 will be discussed in greater detail below with reference to FIG. 3. In an embodiment in which functionality associated with AVR 470, and more particularly computing device 410, is implemented using a PC, communicator 414 could be implemented as a radio dongle coupled to the PC.

Each loudspeaker 440-447 is connected to AVR 470 through either a wired connection or a wireless connection. The wired connection may be analog or digital. The wired connection may utilize a standard protocol such as, for example, Universal Serial Bus (USB), Ethernet, RS232, RS422, and can optionally also carry power using, for example, USB or Power-Over-Ethernet (POE). The wireless connection may utilize any medium including but not limited to ultrasound, radio frequency (RF), ultra high frequency (UHF), and/or infrared (IR). Optionally, the wireless connection may utilize a standard protocol such as, for example, Bluetooth®, WiFi, Zigbee®, and/or Digital Enhanced Cordless Telecommunications (DECT).

In order to calibrate the loudspeakers for optimum performance at each of the six listening positions 450-455, a user would first place a wireless microphone or other wireless audio input device at each of the six listening positions 450-455. The microphones could be positioned with separate stands or with devices that hang on the upright portions of chairs to locate the microphones where the head of a seated person would be. Each wireless microphone or other wireless audio input device is capable of communicating with AVR 470, and more particularly communicator 414, using, for example, ultrasound, RF, UHF, and/or IR. Optionally, this wireless communication may utilize a standard protocol such as, for example, Bluetooth®, WiFi, Zigbee®, and/or DECT. Preferably, the wireless microphone is powered by a battery and does not require any cord or cable for operation.

In one embodiment, AVR 470, and more particularly communicator 414, sends a signal to the wireless microphones at one or more of the listening positions 450-455 to alert the wireless microphones to get ready for the calibration process. Upon receiving this alert signal, the wireless microphones may record a series of tones output by one or more of the loudspeakers 440-447 once an audio signal having an amplitude over a specific threshold is detected.

AVR 470, and more particularly audio signal generator 412, would then cause one or more of the loudspeakers 440-447 to play a series of one or more tones. In one embodiment, discussed in further detail below, AVR 470 sequentially causes each of the loudspeakers to play the series of one or more tones. This series of one or more tones may comprise, for example, pink noise, logarithmic frequency sweep, white noise, linear frequency sweep, sine wave sweep, maximum length sequence (MLS) signals, frequency chirps, or other frequency response measurement signals known to one skilled in the art. The wireless microphones will simultaneously record the series of one or more tones at each of the listening positions 450-455. This represents a significant advantage relative to prior art techniques which require a user to use a single microphone to sequentially record the series of one or more tones at each of the listening positions.

In contrast to conventional techniques in which a single microphone transmits raw audio data to be processed by AVR 470, an illustrative embodiment of the present invention advantageously processes the raw audio data in the microphone and, transmits values obtained from processing the raw audio data instead of transmitting the raw audio data itself. This advantageously allows each microphone to transmit kilobytes, rather than megabytes, of data and thus conserves valuable bandwidth, which can allow for multiple wireless microphones to share a single wireless channel in some embodiments of the present invention.

The wireless microphones at each of the listening positions 450-455 will then wirelessly transmit signals to the AVR 470, and more particularly communicator 414, which will then be used by computing device 410 and/or audio processor 404 to perform acoustic calibration of loudspeakers 440-447 as further discussed below. In one embodiment, discussed in further detail below, AVR 470, and more particularly communicator 414, sends a polling signal to each of the wireless microphones sequentially, and each of the wireless microphones responds sequentially by wirelessly transmitting signals to AVR 470, and more particularly communicator 414, over a common wireless channel (e.g., a single frequency or logical channel). In other embodiments, two or more of the wireless microphones may simultaneously transmit signals to AVR 470, and more particularly communicator 414, either over a common wireless channel and/or over separate wireless channels.

After communicator 414 of AVR 470 receives the signals from the wireless microphones, computing device 410 processes the signals to determine appropriate adjustments to be made to one or more of the loudspeakers or other audio output devices 440-447 by audio processor 404. Note that computing device 410 need not be included within AVR 470 but could instead be implemented as a separate component such as a PC.

For example, computing device 410 can combine the data from each microphone that corresponds to the frequency response of a particular speaker. Various algorithms could be used to combine these responses to determine a corrective transfer function to be applied in audio processor 404 to improve the frequency response of each speaker in each of the listening positions. In some embodiments, computing device 410 can combine the frequency response data from multiple locations to determine a single corrective response that improves the acoustics for most locations.

Examples of filters which may be used to alter the frequency response in embodiments of the present invention include finite impulse response (FIR), parametric equalization, and graphic equalization. Further details regarding algorithms suitable for use with embodiments of the present invention may be found in the aforementioned U.S. Pat. No. 7,483,540, U.S. Pat. No. 7,567,675, U.S. Pat. No. 8,094,826, and U.S. Patent Application Publication No. 2006/0147057, as well as U.S. Pat. No. 4,888,809, U.S. Pat. No. 5,511,129, and U.S. Patent Application Publication No. 2005/0008170, the disclosures of which are incorporated by reference herein.

AVR 470 can also compensate for the relative delay of each speaker 440-447 to a seating position 450-455. Often, the delay relative to the other speakers is more important than the absolute delay for each speaker. Indeed, measuring absolute delay with a wireless system is often difficult due to the variation in latency of wireless microphones. However, by producing a transient sound from a reference speaker (e.g., front center speaker 441) to another speaker (e.g., rear center speaker 446), one can eliminate the wireless microphone latency and instead just measure the relative delay between the reference speaker (e.g., front center speaker 441) and the other speaker (e.g., rear center speaker 446).

Once all speakers are measured, a table of the speaker delays relative to the reference speaker (e.g., front center speaker 441) could be calculated. With this table, the surround sound processor 402 delay parameters could be determined. A calculated delay could then be computed as a signed value in milliseconds, which represents the arrival time of a sound from a reference speaker (e.g., front center speaker 441) to another speaker. Delays would typically be calculated for a primary seating position (e.g., seating position 451), but could be calculated for all positions if desired. If all positions measure the delays, then a virtual map of the location of each microphone could be calculated and, optionally, graphically displayed.

To set the volume trim level of each speaker in a theater, at least one wireless microphone, for example in a primary seating position (e.g., seating position 451), can be used to measure the amplitude of the sound from each speaker over an appropriate bandwidth and to calculate a relative level for each speaker. These measured levels are then used to calculate the trim level in audio processor 402. Thus, computing device 410 can calculate corrective gain trim levels to produce desired sound pressure level (SPL) outputs for each speaker. Additionally or alternatively, computing device 410 can calculate a bass management crossover frequency to be used to route bass information from smaller speakers to a subwoofer.

FIG. 2 shows an exemplary method suitable for use with an embodiment of the present invention. In step 510, AVR 470 sends an alert signal to a plurality of microphones deployed at respective ones of a plurality of listening positions (e.g., listening positions 450-455). In step 520, a series of one or more tones are output by a loudspeaker (e.g., speaker 440). In step 530, a plurality of data signals are substantially simultaneously generated by the plurality of microphones based on the series of one or more tones sent from the loudspeaker.

In step 540, AVR 470 sends a polling signal to a specific wireless microphone (e.g., the microphone at listening position 450). In step 550, that specific wireless microphone (e.g., the microphone at listening position 450) sends back to AVR 470 the data signal that that specific wireless microphone generated in step 530 based on the series of tones output in step 520. In step 570, AVR 470 tests to see whether all of the plurality of wireless microphones have been polled. If not, steps 540 and 550 are repeated for another one of the plurality of wireless microphones (e.g., the microphone at listening position 451). Thus, AVR 470 sequentially polls and receives data signals from each of the plurality of wireless microphones. In one embodiment, this sequential polling advantageously allows each of the plurality of wireless microphones to transmit its respective data signal over the same wireless channel, which can thus be shared by all of the plurality of wireless microphones.

Once step 560 determines that all of the microphones have been polled, step 570 determines whether all loudspeakers (e.g., speakers 440-447) have been processed. If not, then steps 510-560 are repeated with a different one of the loudspeakers (e.g., speaker 441) outputting a series of tones. In another embodiment, only steps 520-560 are repeated and only a single alert signal needs to be transmitted in order to prepare the microphones for processing of the entire plurality of speakers.

Thus, each of the loudspeakers sequentially outputs a series of tones (either the same series of tones or a different series of tones), with each series of tones output by a given loudspeaker being substantially simultaneously processed by each of the plurality of microphones at the respective listening positions (e.g., 450-455) in the manner discussed above. In step 580, once each of the loudspeakers has been processed, AVR 470 performs acoustic calibration of the plurality of loudspeakers (e.g., 440-447) for the plurality of listening positions (e.g., 450-455) based on the plurality of data signals received from the plurality of wireless microphones, as discussed above.

It is important to note that the method shown in FIG. 2 is strictly exemplary. For example, it may be desirable in some embodiments to omit the alert signal (step 510), the sequential polling of microphones (steps 540 and 560), and/or the sequential processing of speakers (step 570). For example, if the sequential polling of microphones is omitted, each microphone may be configured to wirelessly transmit a data signal as soon as it is generated by that microphone, which may result in the data signals being transmitted from the microphones substantially simultaneously rather than sequentially. As another example, if the sequential processing of speakers is omitted, multiple speakers could simultaneously output different tones, and a given microphone could be operative to generate a single data signal based on the different tones simultaneously output by the multiple speakers.

FIG. 3 shows a wireless audio input device (wireless microphone 600) suitable for use with an embodiment of the present invention. As discussed above, a wireless microphone 600 may be deployed at each of the listening positions 450-455 within listening area 402. Wireless microphone 600 includes transducer 610, conditioner (e.g., preamplifier) 620, analog-to-digital converter (ADC) 630, digital signal processor (DSP) 640, and communicator 650. Communicator 650 will be discussed in greater detail with respect to FIG. 3.

Transducer 610 may comprise any type of microphone capsule known to one skilled in the art including but not limited to: condenser (including electret), dynamic, MEMS (MicroElectrical-Mechanical System), piezoelectric, fiber optic, liquid, and/or laser. It may be desirable to use a transducer with a relatively flat frequency response. In one embodiment, transducer 610 may be implemented using the WM-61A Omnidirectional Back Electret Condenser Microphone Cartridge commercially available from Panasonic Corporation. Literature available on Panasonic Corporation's website on the filing date of the present application is submitted herewith and incorporated by reference herein.

Conditioner 620 is an optional component which processes the output produced by transducer 610 in order to produce a signal acceptable for digitizing by ADC 630. For example, conditioner 620 may include a preamplifier to provide gain to the output produced by transducer 610. Other embodiments may omit conditioner 620, e.g., where transducer 610 will itself produce a signal acceptable for digitizing by ADC 630. ADC 630 digitizes the output of transducer 610 and/or conditioner 620. For example, ADC 630 may produce a pulse-code modulated (PCM) or pulse-density modulated (PDM) digital representation of the analog signal produced by transducer 610 and/or conditioner 620. It may be desirable to provide a sample rate of at least 44.1 kilohertz (KHz) so that a frequency response up to 20 KHz could be measured.

DSP 640 processes the digitized output received from ADC 630 and determines various values to be used for acoustic calibration. It is important to note that the data generated by DSP 640 will be much smaller in size (e.g., a few kilobytes) than the raw audio data generated by transducer 610, conditioner 620, and/or ADC 630. Hence, incorporation of DSP 640 into wireless microphone 600 will greatly reduce the amount of data that needs to be transmitted from wireless microphone 600 to AVR 470.

DSP 640 may measure one or more numeric values associated with the raw audio data, such as frequency response, amplitude, and/or relative time delay. DSP 640 may use any one of a number of well-known algorithms, such as discrete Fourier transform (DFT) or fast Fourier transform (FFT), to convert the time domain samples generated by ADC 630 into frequency response data. DSP 640 may calculate the delay between two or more signals to calculate relative speaker to microphone delays. DSP 640 may calculate the SPL of the digitized microphone signal generated by ADC 630 utilizing a bandwidth weighting method (e.g., A-weighting or ITU-R 486 noise weighting).

In one embodiment, microphone 600 includes memory 645 which stores calibration data specific to that microphone (e.g., correction curves). This calibration data can be used by DSP 640 to correct the calculated acoustic parameters, thereby resulting in communication of corrected acoustic parameters by communicator 650. This advantageously allows the use of a variety of microphones for calibration, in contrast with prior art techniques which require the use of a specific microphone. Memory 645 is preferably implemented using a non-volatile memory (NVM) such as, for example, read-only memory (ROM) such as electrically erasable programmable read-only memory (EEPROM), non-volatile random-access memory (NVRAM) such as Flash memory, or magnetic storage such as a hard drive.

As would be understood by one skilled in the art, DSP 640 may be implemented using a general-purpose microcontroller which has been programmed with software instructions, or DSP 640 may incorporate special-purpose hardware and/or firmware. In one embodiment, conditioner 620, ADC 630, DSP 640 and communicator 650 may all be implemented using the BlueCore5®-Multimedia (BC5-MM) chipset commercially available from Cambridge Silicon Radio (CSR) plc. Literature available on CSR plc's website on the filing date of the present application is submitted herewith and incorporated by reference herein.

Communicator 650 is operative to communicate with AVR 470, and more particularly communicator 414. Communicator 650 should be capable of at least transmitting signals (e.g., the aforementioned numeric values) to AVR 470, but in some embodiments it may also be desirable for communicator 650 to receive signals from AVR 470 (e.g., the aforementioned alert and polling signals). Hence, communicator 650 may comprise a transmitter, a receiver, and/or a transceiver. Communicator 650 may operate on any frequency, including but not limited to ultrasound, RF, UHF and IR. Communicator 650 may optionally utilize one or more protocols such as, for example, Bluetooth®, WiFi, Zigbee®, and/or DECT.

FIG. 4 shows an exemplary implementation of communicator 650 and/or communicator 414 suitable for use with an embodiment of the present invention. Communicator 650 and/or communicator 414 comprises transceiver 710 which includes a transmitter (TX) and a receiver (RX). Transmitter TX is coupled to a power amplifier (PA) 720, and receiver RX is coupled to a low-noise amplifier (LNA) 730. PA 720 and LNA 730 are coupled to switch 740, which is capable of switching between these two amplifiers based on a switch control signal 750 generated by transceiver 710. Hence, transceiver 710 uses switch 740 to control whether antenna 760 is receiving or transmitting signals at any given time.

The preferred embodiment of the present invention is described herein in the context of speakers and wireless microphones, but is not limited thereto, except as may be set forth expressly in the appended claims. Those skilled in the art will appreciate that the present invention can be applied to many types of audio output devices and wireless audio input devices.

INDUSTRIAL APPLICABILITY

To solve the aforementioned problems, the present invention is a unique system in which multiple wireless audio input devices (e.g., wireless microphones) are used to calibrate one or more audio output devices (e.g., loudspeakers).

LIST OF ACRONYMS USED IN THE DETAILED DESCRIPTION OF THE INVENTION

The following is a list of the acronyms used in the specification in alphabetical order.

ADC Analog-to-Digital Converter
ASC Automatic Sound Calibration
AVR Audio-Video Receiver
BC5-MM BlueCore5-MultiMedia
CSR Cambridge Silicon Radio
DCAC Digital Cinema Auto Calibration
DECT Digital Enhanced Cordless Telecommunications
DFT Discrete Fourier Transform
DSP Digital Signal Processor
EEPROM Electrically Erasable Programmable Read-Only Memory
FFT Fast Fourier Transform
IR InfraRed
KHz KiloHertz
LNA Low Noise Amplifier
MCACC Multi-Channel Acoustic Calibration
MEMS MicroElectrical-Mechanical System
MLS Maximum Length Sequence
NVRAM Non-Volatile Random-Access Memory
PA Power Amplifier
PC Personal Computer
PCM Pulse-Code Modulated
PDM Pulse-Density Modulated
POE Power-Over-Ethernet
RCS Room Correction System
RF Radio Frequency
RMC Room Mode Correction
ROM Read-Only Memory
RX Receiver
SPL Sound Pressure Level
TX Transmitter
UHF Ultra High Frequency
USB Universal Serial Bus
YPAO Yamaha Parametric room Acoustic Optimizer

ALTERNATE EMBODIMENTS

Alternate embodiments may be devised without departing from the spirit or the scope of the invention. For example, the inventive device could be adapted to many types of audio output devices and wireless audio input devices.

What is claimed is:

1. A method for use in performing acoustic calibration of at least one audio output device for a plurality of listening locations, said method comprising the steps of:

an audio input device generating a data signal based on a series of one or more audio tones output by said at least one audio output device; and said audio input device wirelessly transmitting said data signal to a calibration device;

wherein said audio input device is one of a plurality of audio input devices deployed at respective ones of said plurality of listening locations; and wherein said data signal is one of a plurality of data signals generated by respective ones of said plurality of audio input devices based on said series of one or more tones output by said at least one audio output device; and wherein said plurality of data signals are wirelessly transmitted by said respective ones of said plurality of audio input devices to said calibration device.

2. The method of claim 1, wherein said audio input device comprises a wireless microphone and wherein said at least one audio output device comprises at least one loudspeaker.

3. The method of claim 1, wherein said calibration device comprises at least one of an audio-video receiver (AVR) and a personal computer (PC).

4. The method of claim 1, wherein said plurality of data signals are generated substantially simultaneously by said respective ones of said plurality of audio input devices.

5. The method of claim 1, wherein said plurality of data signals are wirelessly transmitted sequentially by said respective ones of said plurality of audio input devices.

6. The method of claim 1, wherein at least two of said plurality of data signals are wirelessly transmitted over a common wireless channel.

7. The method of claim 1, wherein generating said data signal is responsive to said audio input device receiving an alert signal from said calibration device.

8. The method of claim 7, wherein said alert signal is transmitted substantially simultaneously to said respective ones of said plurality of audio input devices.

9. The method of claim 1, wherein said step of wirelessly transmitting said data signal by said audio input device to said calibration device is responsive to said audio input device receiving a polling signal from said calibration device.

10. The method of claim 9, wherein said polling signal is transmitted sequentially to said respective ones of said plurality of audio input devices.

11. The method of claim 1, wherein generating said data signal comprises the steps of:

(a) generating raw audio data by transducing at least a portion of said common series of one or more tones output by said at least one audio output device; and (b) processing said raw audio data to determine one or more numerical values associated therewith.

12. The method of claim 11, wherein wirelessly transmitting said data signal comprises transmitting said one or more numerical values associated with said raw audio data instead of said raw audio.

13. The method of claim 12, wherein wirelessly transmitting said data signal further comprises transmitting said one or more numerical values associated with said raw audio data instead of a compressed or companded version of said raw audio.

14. The method of claim 11, wherein said one or more numerical values comprise at least one of:

(a) at least one frequency response value;

(b) at least one amplitude value;

(c) at least one delay value.

15. The method of claim 11, wherein processing said raw audio data comprises the steps of:

(a) digitizing said raw audio data; and (b) applying digital signal processing to said digitized raw audio data.

16. The method of claim 15, wherein said digital signal processing comprises converting at least one time domain sample within said digitized raw audio data into at least one frequency response.

17. The method of claim 15, wherein said digital signal processing comprises at least one of a discrete Fourier transform (DFT) and a fast Fourier transform (FFT).

18. The method of claim 15, wherein said digital signal processing comprises calculating a sound pressure level of said digitized raw audio data.

19. The method of claim 15, wherein said digital signal processing comprises applying a bandwidth weighting method to said digitized raw audio data.

20. The method of claim 15, wherein said audio input device is operative to store calibration data specific to said audio input device, and wherein said digital signal processing comprises applying said calibration data to said digitized raw audio data.

21. The method of claim 1, wherein said audio input device is operative to store calibration data specific to said audio input device, and wherein said data signal generated by said audio input device is based at least in part on said calibration data.

22. The method of claim 1, further comprising the step of said calibration device performing said acoustic calibration of said at least one audio output device based on said plurality of data signals.

23. An audio input device for use in performing acoustic calibration of at least one audio output device for a plurality of listening locations, said audio input device comprising:

a processor operative to generate a data signal based on a series of one or more tones output by said at least one audio output device; and a communicator operative to wirelessly transmit said data signal to a calibration device;

wherein said audio input device is one of a plurality of audio input devices deployed at respective ones of said plurality of listening locations;

wherein said data signal is one of a plurality of data signals generated by respective ones of said plurality of audio input devices based on said series of one or more tones output by said at least one audio output device; and wherein said plurality of data signals are wirelessly transmitted by said respective ones of said plurality of audio input devices to said calibration device.

24. The audio input device of claim 23, said audio input device further comprising a memory operative to store calibration data specific to said audio input device, wherein said data signal generated by said processor is based at least in part on said calibration data.

25. A method for use in performing acoustic calibration of at least one audio output device for a plurality of listening locations, said method comprising the steps of:

a calibration device wirelessly receiving a plurality of data signals from respective ones of a plurality of audio input devices deployed at respective ones of said plurality of listening locations; and the calibration device performing said acoustic calibration of said at least one audio output device based on said plurality of data signals;

wherein each of said plurality of data signals is generated by a respective one of said plurality of audio input devices based on a series of one or more tones output by said at least at least one audio output device.

26. A calibration device for use in performing acoustic calibration of at least one audio output device for a plurality of listening locations, said calibration device comprising:

a communicator operative to wirelessly receive a plurality of data signals from respective ones of a plurality of audio input devices deployed at respective ones of said plurality of listening locations; and a processor operative to perform said acoustic calibration of said at least one audio output device based on said plurality of data signals;

wherein each of said plurality of data signals is generated by a respective one of said plurality of audio input devices based on a series of one or more tones output by said at least one audio output device.

27. A system for use in performing acoustic calibration of at least one audio output device for a plurality of listening locations, said system comprising:

a plurality of audio input devices deployed at respective ones of said plurality of listening locations; and a calibration device;

wherein said plurality of audio input devices wirelessly transmits a plurality of data signals to said calibration device; and wherein each of said plurality of data signals is generated by a respective one of said plurality of audio input devices based on a series of one or more tones output by said at least one audio output device.

28. The system of claim 27, wherein said calibration device performs said acoustic calibration of said at least one audio output device based on said plurality of data signals.

29. The system of claim 27, wherein said calibration device is coupled to said at least one audio output device through one or more wires.

30. The system of claim 29, wherein said calibration device is operative to:

(a) transmit signals to said at least one audio output device through said one or more wires; and (b) supply power to said at least one audio output device through said one or more wires.

31. The system of claim 27, wherein said calibration device is wirelessly coupled to said at least one audio output device.

32. A method for use in performing acoustic calibration of at least one audio output device for a plurality of listening locations, said method comprising the steps of:

a plurality of audio input devices generating respective ones of a plurality of data signals based on a series of one or more audio tones output by said at least one audio output device; and said plurality of audio input devices wirelessly transmitting said plurality of data signals to a calibration device;

wherein said plurality of audio input devices are deployed at respective ones of said plurality of listening locations.

33. The method of claim 32, wherein said plurality of audio input devices comprises respective wireless microphones and wherein said at least one audio output device comprises at least one loudspeaker.

34. The method of claim 32, wherein respective ones of said plurality of data signals are generated substantially simultaneously by respective ones of said plurality of audio input devices based on said series of one or more audio tones output by said at least one audio output device.

35. The method of claim 32, wherein respective ones of said plurality of data signals are sequentially transmitted by respective ones of said plurality of audio input devices over a common wireless channel.

36. A method for use in performing acoustic calibration of at least one loudspeaker for a plurality of listening locations, said method comprising:

(a) a calibration device transmitting a first signal substantially simultaneously to a plurality of wireless microphones deployed at respective ones of said plurality of listening locations;

(b) responsive to a given one of said plurality of wireless microphones receiving said first signal, said given wireless microphone generating a second signal based on a series of one or more tones output by said at least one loudspeaker;

(c) said calibration device transmitting a third signal sequentially to respective ones of said plurality of wireless microphones; and (d) responsive to said given wireless microphone receiving said third signal, said wireless microphone wirelessly transmitting said second signal to said calibration device;

(e) said second signal being one of a plurality of signals substantially simultaneously generated by respective ones of said plurality of wireless microphones based on said series of one or more tones output by said at least one loudspeaker;

(f) said plurality of signals being sequentially wirelessly transmitted by said respective ones of said plurality of wireless microphones to said calibration device responsive to said respective ones of said plurality of wireless microphones receiving said third signal; and (g) said calibration device performing said acoustic calibration of said at least one loudspeaker based on said plurality of signals.

* * * * *